US005147527A

United States Patent [19]

Hettinger

[11] Patent Number: 5,147,527

[45] Date of Patent: Sep. 15, 1992

[54] MAGNETIC SEPARATION OF HIGH METALS CONTAINING CATALYSTS INTO LOW, INTERMEDIATE AND HIGH METALS AND ACTIVITY CATALYST

[75] Inventor: William P. Hettinger, Russell, Ky.

[73] Assignee: Ashland Oil, Inc., Ashland, Ky.

[21] Appl. No.: 332,079

[22] Filed: Apr. 3, 1989

[51] Int. Cl.[5] ..... C10G 11/05

[52] U.S. Cl. ..... 208/120; 208/113; 208/118; 208/152; 502/5; 502/21; 209/8; 209/636

[58] Field of Search ..... 208/113, 120, 118, 152; 502/5, 21; 209/8, 636

[56] References Cited

U.S. PATENT DOCUMENTS

| | | | |
|---|---|---|---|
| 2,160,874 | 6/1949 | Kinsel | 252/2 |
| 2,490,774 | 12/1949 | Bland | 196/52 |
| 2,607,492 | 8/1952 | Anders | 210/1.5 |
| 2,688,403 | 9/1954 | Anderson | 210/1.5 |
| 2,694,622 | 11/1954 | Reed et al. | 23/260 |
| 2,760,638 | 8/1956 | Arnett et al. | 210/1.5 |
| 2,775,607 | 12/1956 | Kolbel et al. | 260/449.6 |
| 2,956,004 | 10/1960 | Conn | 208/91 |
| 4,167,474 | 9/1979 | Sikonia | 208/140 |
| 4,280,896 | 7/1981 | Bearden | 208/113 |
| 4,292,171 | 9/1981 | Mayer | 208/164 |
| 4,294,688 | 10/1981 | Mayer | 208/164 |
| 4,332,674 | 6/1982 | Dean et al. | 208/120 |
| 4,334,920 | 6/1982 | Mori | 75/26 |
| 4,406,773 | 9/1983 | Hettinger, Jr. et al. | 208/120 |
| 4,482,450 | 11/1984 | Ushio | 208/152 |
| 4,541,920 | 9/1985 | Seiver | 208/138 |
| 4,551,437 | 11/1985 | Berrebi | 502/5 |
| 4,729,821 | 3/1988 | Timmons et al. | 204/164 |
| 4,835,128 | 5/1989 | Child | 502/21 |
| 4,898,116 | 2/1990 | Kozne et al. | 118/621 |
| 4,910,538 | 3/1990 | Ochiai et al. | 346/162 |
| 4,912,516 | 3/1990 | Kaieda | 358/274 |

OTHER PUBLICATIONS

By Bo R. Arvidson, Ore Sorters (North America) Inc., given at "II International Mineral Processing Symposium", Izmir, Turkey, Oct. 4–6, 1988.

By Bo. R. Arvidson, Bateman Equipment, Inc., "New High-Intensity Roll Separator Using Permanent Magnets", Canadian Mining & Metallurgical Bulletin, Jul. 1985.

*Primary Examiner*—Asok Pal

*Attorney, Agent, or Firm*—Richard C. Willson, Jr.

[57] ABSTRACT

One embodiment is an improved process for economically converting carbo-metallic oils by means of catalytic particulates into lighter products, wherein a portion of the particulates is withdrawn and passed through a high strength magnetic field of at least 1 KG and field grandients of at least 10 KG/inch while conveyed on an electrostatic conducting belt to enable separation of the mass of particulates by inertia into at least two fractions; one of which has, in the case of catalyst, higher activity and lower metals content and is recycled back to the unit; a second higher metals, lower activity catalyst which is disposed of or treated for recovery of metals; and optimally, intermediate fraction which can be disposed of, or first treated to remove metals, and then chemically reactivated and returned to the unit.

Another embodiment is an improved metals removal process employing very low activity sorbent to remove metals and Conradson Carbon, wherein a portion of said sorbent is withdrawn and passed through a high strength magnetic field of at least 1 KG, field gradient of at least 10 KG/inch, while conveyed on an electrostatic conducting belt, whereby at least two fractions of different metals levels are obtained.

35 Claims, 5 Drawing Sheets

MAGNETIC SEPARATION OF HIGH METALS CONTAINING CATALYSTS INTO LOW, INTERMEDIATE AND HIGH METALS AND ACTIVITY CATALYST

TECHNICAL FIELD

This invention relates to improved processes for carrying out heavy hydrocarbon conversions, such as removal of metals, and catalytic cracking to lighter molecular weight fractions; wherein magnetic separation is employed. More particularly, this technical invention involves the application of rare earth enhanced magnetic field gradients.

BACKGROUND ART

Magnetic methods for the treatment of material by J. Svovoda published by Elsevier Science Publishing Company, Inc., New York (ISBNO-44-42811-9) Volume 8) discloses both theoretical equation describing separation by means of magnetic forces with the corresponding types of equipment that may be so employed. Specific reference is made to cross-belt magnetic separators and other belt magnetic separators involving a permanent magnet roll separator. The permanent magnet roll separator similar to that shown in FIGS. 1 and 2 of the instant application is shown on page 144.

U.S. Pat. No. 4,406,773 (1983) of W. P. Hettinger, Jr. et. al discloses use of high magnetic field gradients produced from SALA-HGMS (high-intensity, high gradient magnetic separators). A carrousel magnetic separator containing a filamentary matrix within produces a high magnetic field gradient. Unfortunately, the filamentary material tends to catch particulates based in part upon size rather than magnetic susceptibility. Also the capacity of these units are limited since they must be from time to time be stopped to remove particles that have been captured by the filamentary matrix. The instant invention is an improvement over this method insofar as it provides a process that is continuous, and avoids difficulties associated with variations in particle size.

U.S. Pat. No. 2,604,207 (1952) of W. J. Scott discloses an apparatus for separating magnetic from non-magnetic particles by means of permanent or electromagnetic magnets employed in connection with a moving belt. The belt moves through a quiescent liquid countercurrent to the direction of freely falling particulates. The magnetic particulates are attracted to the belt which is then scraped to remove magnetic particulates and which continues in an endless path through the quiescent liquid.

U.S. Pat. No. 3,463,310 (1969) of S. Ergun, et al. assigned to the United States of America discloses a process for separating a mixture finely divided particulate materials having particle size in the range 40 to 400 mesh. The process takes advantage of the conductivity differences to electromagnetic radiation between pyrite and coal to selectively heat the surface of the pyrite particles and thereby increasing, their magnetic properties. Claimed is the generalized means of separating materials susceptible to change in magnetic properties upon heating.

U.S. Pat. No. 3,901,795 (1975) of Smith, et al. assigned to Continental Can Company, Inc. discloses an apparatus for separating magnetic from non-magnetic materials wherein a first belt transfers a mixture of magnetic and non-magnetic materials into proximity of a magnetic transferring means which in effect transfers the magnetic material to a second belt. Permanent or electromagnetic fields are expressly disclosed. To provide more definitive separation, an air stream removes some of the non-magnetic materials from the second transfer belt that can be magnetic.

U.S. Pat. No. 1,390,688 (1921) of C. Ellis discloses a magnetic separation of catalytic material by means of an electromagnetic or permanent magnet, wherein finely divided nickel or magnetizable nickel oxide are removed from fatty acid oils prior to filtration of the fatty acid oils. The oil in suspended catalyst are allowed to flow past a plate under which electromagnets are placed causing the suspended catalyst to collect in a spongy mass around the magnetic poles and allowing the oil to pass off in the state of substantial clarity.

U.S. Pat. No. 2,348,418 (1944) of W. G. Roesch, et al. discloses a method to improve separation of hydrocarbon conversion catalyst from regeneration gases. Disclosed and claimed is the fact that fine sized particulates may be separated from flue gases by means of a magnetic field. After an initial separation of regeneration gases from regenerated catalyst, the regeneration gases are submitted to a reduction thereby reducing any magnetizable fine particulates to a magnetic state and then passing the material through a magnetic field. There is no discussion of discriminating between different catalyst having different amount of metals.

U.S. Pat. No. 2,471,078 (1949) of H. J. Ogorzaly discloses separation of iron containing particulates from a catalyst having particle sizes in the range of 5 to 160 microns and higher used in a fluid catalytic cracking process. Catalyst quality is improved by magnetically separating iron contaminants prior to any significant introduction of the iron contaminants into the catalyst itself. The iron particulates tend to be small fines which would otherwise not be readily separated by a cyclone. Iron particulates are removed from reactant gases from the reaction zone and regeneration gases removed from the regeneration zone by subjecting such gases to a magnetic field under conditions to remove undesirable iron particulates. There is no teaching to show discrimination among the catalyst otherwise removed from the reaction that resolve from a cyclone separation. There is no teaching to suggest that iron or other contaminated particulates could or should be removed from that mixture of materials that result from separating in a cyclone or other separation means.

U.S. Pat. No. 2,631,124 (1953) of H. J. Ogorzaly discloses removal of undersirable iron particulates in a particle size range of 5 to about 160 microns and larger. In a wet condition involving passing iron particulates contained in product gases from a tracking zone which have been subjected to a fractionation. The main difference between this process claimed in patent '124 from that disclosed in patent '078 is that the material is wet in '124 and dry in '078 and the material has undergone a fractionation in '124 to form a slurry prior to separation.

U.S. Pat. No. 2,723,997 (Nov. 15, 1955) entitled Separation of Catalyst from Liquid Products discloses separation of cobalt nickel or iron from liquid reaction products by means of a magnetic field employing, for example, permanent or electromagnets providing a series of fields of progressively increasing intensity through which the liquid passes. In one arrangement, the number of magnets increases progressively in the direction of flow of the liquid, which may be upward, downward or horizontal with respect to a vessel.

U.S. Pat. No. 2,635,749 (Apr. 21, 1953) discloses a method of separating active from inactive inorganic oxide catalyst that are in finely divided form. Catalyst are indicated to include those involved in cracking heavier oils such as gas oil into gasoline. Separation is effected by an electrostatic field wherein it was found that the less active catalyst fags through a cone or barrier onto succeeding electrodes without deflection. The more active catalysts tend to be deflected more extensively. Specifically, the electrostatic field is disclosed to be a pulsating electrostatics field with a strength of between 3,000 and 15,000 volts per centimeter.

U.S. Pat. No. 1,576,690 (Mar. 16, 1926) discloses a process for the magnetic separation of material on a plurality of separating rolls wherein separate strong and weak magnetic ores whether natural or treated are separated. The field strength at various points increases so that magnetic material of different strengths can be separated.

U.S. Pat. No. 2,459,343 (Jan. 18, 1949) discloses a means of removing ferrous and other particulate matter from liquids.

U.S. Pat. No. 4,772,381 (Sep. 20, 1988) discloses a method for separating a mixture of solid particulates that include non-magnetic electrically conductive metals into light and a heavy fraction. This is achieved by means of an alternating magnetic field in combination with an air flow which effects separation of light and heavy fractions of material. Specifically the electrically conducted particles are influenced by the alternating magnetic field and can be substantially accelerated in a desired manner.

U.S. Pat. No. 2,065,460 (Dec. 22, 1936) discloses use of a rotor to effect separation of weakly magnetic and non-magnetic materials by rotating the surface of the rotator through a maximum density of magnetic flux which is near the top of the rotor. Separation is affected because the more magnetically attractive material tends to stay on the rotor longer than material of a non-magnetic nature which tends to, as a result of momentum, go further outward and are separated into streams by means of blades defining different paths. The point at which non-magnetic particles project from the rotor are a function of speed of rotation of the rotor, friction between the particle and surface of the rotor, and the size and density of the particle.

U.S. Pat. No. 3,010,915 (Nov. 28, 1961) discloses a process involving nickel on kieselguhr catalyst for recycle of magnetically separated magnetic catalyst back to be used for further reactions. The catalyst size is from 1 to 8 microns. The specific nature of the magnetic separator is not considered the critical feature of the invention.

U.S. Pat. No. 4,021,367 (May 3, 1977) discloses a process for removing suspended metal catalyst from a liquid phase by continuously moving magnetic field of minimum intensity. Ferromagnetic materials are disclosed to be easily separated from a wide variety of solutions having a large range of viscosities. A continuously moving magnetic field has a minimum intensity of 200 oersteds produced by at least two disks rotating on a common shaft.

U.S. Pat. No. 4,359,379 (Nov. 16, 1982) discloses use of a high gradient magnetic separator using a ferromagnetic matrix placed in a uniform high magnetic field to generate a high magnetic field gradient around the matrix. Catalyst particles made magnetic by deposition of at least one metal selected from the group consisting of nickel, vanadium, iron, and copper are separated and the relatively non-magnetic particles from the fluid catalystc cracking unit are returned for reuse. The metals deposited on a catalyst are disclosed to arise from a fluid catalytic cracking process magnetic gradient is 2 mm to 20 mm Gauss per centimeter with a field strength of 1 m to 20 m Gauss.

U.S. Pat. No. 4,029,495 (Jun. 14, 1977) discloses a process for recovering heavy metal catalyst components from a waste catalyst. The metal components consist of nickel, copper, molybdenum, vanadium or copper and the like which are induced to coalesces as a discreet mass separate and apart from other waste catalyst components. If flux is added during the process followed by heating and mixing and crushing to form particulates of waste catalyst and metallic components of the catalyst into separate distinct entities which are then separated by means of a high powered magnetic separator for rough separation followed by a more precise magnetic separation.

U.S. Pat. No. 3,725,241 (Apr. 3, 1973) discloses separation of hydrogenation of ash particles renders them susceptible to be removed by magnetic means. It was opined that the iron in the ash was converted by hydrogenation to a reduced form that in a magnetic field lead to separations as a result of a magnetic field having a strength of greater than about 10 m. Gauss. Process involved a coal liquefication improved by separating magnetically susceptible particles in a magnetic field of at least about 5 m Gauss. The ash particles add a particle size of less than roughly 200 mesh.

U.S. Pat. No. 4,388,179 (Jun. 14, 1983) discloses separation of mineral matter from carbonaceous fluids derived from oil shale. The process involves subjecting a heated oil shale mineral solid to a temperature at which magnetization of the material occurs. Continue heating above the temperature which magnetic transformation occurs continues to increase with increasing temperature to a maximum temperature at which peak magnetization occurs. Heating much above the point of peak magnetization results in a decrease in magnetization to a value of 0 around the Curie temperature. A variety of magnetic separation techniques are disclosed suitable to oil shale. Among these expressly center are super conducting magnetic separators, high-gradient magnetic separation ("HGMS)" and the like.

U.S. Pat. No. 2,264,756 discloses a method for increasing settling of catalyst particulates used to hydrogenate resins and oils. Specific catalyst disclosed involve nickel. Subjecting the suspended particulates of a hydrogenated product to a magnetic field apparently causes a agglomeration or fluctuation of the particulates so as to increase the rate of settling and therefore, the ease by which such particulates may be removed from a hydrogenation product.

U.S. Pat. No. 4,394,282 (Jul. 19, 1983) discloses a fluidized bed achieved by magnetization of particulates having certain sizes and being in part ferromagnetic.

U.S. Pat. No. 3,926,789 (Dec. 16, 1975) discloses magnetic separation of mixtures containing non-magnetic or paramagnetic materials by selectively changing the magnetic properties of certain of the materials. Specifically, magnetic fluids are caused to selectively wet and coat particles of one composition and add mixture with particles of a different composition. The difference in coating preference of the magnetic composition permits selectively separation of one material from those of another based upon differences in surface properties there between.

U.S. Pat. No. 4,702,825 (Oct. 27, 1987) discloses a super conductor high gradient magnetic separator having unique design features that permit low cost operation and minimal heat loss.

Examples of patents disclosing metals removal and catalytic cracking particularly relevant to this invention are: U.S. Pat. No. 4,341,624; U.S. Pat. No. 4,347,122; U.S. Pat. No. 4,299,687; U.S. Pat. No. 4,354,923; U.S. Pat. No. 4,332,673; U.S. Pat. No. 4,444,651; U.S. Pat. No. 4,419,223; U.S. Pat. No. 4,602,933; U.S. Pat. No. 4,708,785; and U.S. Pat. No. 4,390,415.

Processes disclosed in the foregoing patents are improved by the use of magnetic separation as discussed in more detail in this specification.

All of the references cited hereinbefore are expressly incorporated by reference.

SUMMARY OF THE INVENTION

It is accordingly one object of this invention to provide a catalytic cracking process for converting carbometallic oils to liquid fuels, wherein the catalyst replacement rate is reduced.

It is still another object to provide a catalytic cracking process for converting carbo-metallic oils to liquid fuels, wherein the catalyst removed from the process and disposed of has a lower activity than that of catalyst concurrently being cycled through the process. A second objective of the process is to produce a catalyst higher in activity than the catalyst removed from the unit and to recycle this catalyst back to the unit. A third objective is to produce an intermediate fraction which can be recovered, treated chemically to remove metals and restore activity, and returned to the unit.

In accordance with this invention a process is provided for converting carbo-metallic oils to lighter products comprising: (a) providing a converter feed containing 650° F.+material, said 650° F.+material being characterized by a carbon residue on pyrolysis of at least about one and by containing at least about 4 ppm of Nickel equivalents of heavy metals; (b) bringing particulate catalyst particles into contact with said feed to form a stream comprising a suspension of said particulate in said feed, said particulate comprising high activity particles and/or low activity particles, and causing the resulting stream to flow through a progressive flow reactor having an elongated reaction chamber which is at least in part vertical or inclined for a predetermined vapor residence time in the range of about 0.5 to about 10 seconds, at a temperature of about 900° F. to about 1400° F., and under a pressure of about 10 to about 50 pounds per square inch absolute sufficient for causing a conversion per pass in the range of about 20% to about 90% while producing coke in amounts in the range of about 6 to about 14% by weight based on fresh feed, and laying down coke on the particulate in amounts in the range of about 0.3 to about 3% by weight; (c) separating said particulate from the steam of hydrocarbons formed by vaporized feed and resultant cracking products; (d) regenerating said particulate with oxygen-containing combustion-supporting gas under conditions of time, temperature and atmosphere sufficient to reduce the carbon on the particulate to about 0.25% by weight or less, while forming combustion products comprising $Co_2$ and/or CO; (e) recycling the regenerated particulate to the reactor for contact with fresh feed; (f) withdrawing a portion of the particulate from the cycle; and (g) passing the withdrawn portion of particulate through a magnetic field gradient having sufficient strength to separate with inertial forces such particulate into at least three new fractions.

In carrying out this process the withdrawn particulate, if catalytic, are separated into a fraction having an activity greater than that of the average activity of withdrawn catalyst; a fraction intermediate, and a fraction having at lower activity than the average activity of the withdrawn catalyst. The lower activity portion can be discarded and the higher activity portion returned to the carbo-metallic oil conversion process unchanged. The intermediate fraction can also be disposed of or reactivated chemically and returned to the unit. This process provides a method for separating particles of different activities, permitting further use of higher activity catalyst, thus reducing the rate of addition of fresh catalyst to the system. As noted above, as particulates are recycled the concentration of heavy metals on the catalyst increases and such catalyst gradually becomes less and less ineffective in cracking oils. However, the concentration of heavy metals on a catalyst is not, per se, a quantitative indication of the activity of a catalyst. Catalyst particles may have widely different initial compositions. Some less than about 0.1% of iron. A mixture of these two catalysts could be separated into two fractions when subjected to a magnetic field even if they had the same activity. Catalyst particles having the same initial composition and different cracking histories could have the same activity but different heavy metal loading which could lead to separation of a mixture into two portions even if all particles have virtually the same activity. To be optimally effective, high concentrations of iron in fresh catalyst added to the cycle should have no higher concentration of iron than the average concentration of iron in the catalyst within the cracking system.

This process may be used with particulate within the size range typically used in cracking oils to lighter products, such as, for example, particulate having an average size in the range of 20–250 microns, and the size range may be selected based on considerations other than any requirements imposed by the step of this invention of separating catalysts into masses of different activity levels.

This process segregates catalyst containing particles having a wide range of activities into a portion of higher activity than that of the initial withdrawn mass, an intermediate activity and metal content catalyst fraction, and a portion of lower activity than that of the withdrawn mass. By changing the speed of rotation of the belt through the magnetic field, the amount of lower activity catalyst which is diverted by the magnetic field may be increased or decreased. The average MAT relative activity, as defined below, of the catalyst which passes over the magnetic field preferably is at least about 20 percentage points greater, and most preferably is at least about 40 percentage points greater than the MAT activity of the magnetically deflected catalyst.

In carrying out this process the catalyst may be withdrawn from one or more places at various points in the cycle. A sidestream may be withdrawn, for instance, from the reactor or from a conduit carrying spent catalyst from the reactor to the regenerator, or from a conduit carrying regenerated catalyst from the regenerator to the reactor. In the preferred method of carrying out this invention the catalyst may also be treated at high temperature in $H_2$ so as to place nickel on the catalyst in a reduced state, since nickel in the oxide form exhibits less magnetic susceptibility.

The presence of coke does appear to have an effect on the ability to separate high activity catalyst from low activity catalyst; consequently, the preferred point or points of withdrawal are between the reactor and the final stage of regeneration. If catalyst as withdrawn contains oxidized nickel, it may be subjected to reducing atmosphere before the step of magnetic separation in order to enhance the separation of high from low activity catalyst.

The process of withdrawing and segregating catalyst into high, intermediate and low activity portions may be performed continuously or batchwise and the segregation step may be carried out in one or more stages depending on the extent of separation required. Separation in more than one stage may be achieved by passing a stream of catalyst particles over a series of separate magnetic rolls, preferably of increasing downstream magnetic field strength, or reduced belt speed, or by recycling the stream of particles over the same magnetic field, preferably increasing the field strength with each successive pass.

The rate of withdrawing particulate may be greater than rates used in the absence of a magnetic process with little or no increase and possibly even a decrease in the amount of virgin particulate added since a portion of the withdrawn particulate may be returned to the cracking process. For example, the rate of withdrawal may be about 0.5 to about 5 pounds per barrel of feed processed or even greater than about 5 pounds per barrel of feed. For catalysts, these higher withdrawal rates may be used to raise the activity level of catalyst in the system.

The magnetic field at 0.003 inches from the magnet's surface in Kilo Gauss is suitably in the range of from about 1 KG to more than about 25 KG, and preferably from about 5 KG to about 20 KG. The field gradient at 0.003 inches from the magnet's surface is in the range of about 10 KG/inch to 200 KG/inch, and preferably in the range of about 50 KG/inch to 200 KG/inch.

The magnetic field and gradient of each roller, the rate of belt and roller speed and the thickness of the catalyst layer on the belt as the belt passes over the roller, and the number of passes through a magnetic field are among the factors which determine the extend of separation. For a typical catalyst containing particles having a broad spectrum of activities, the fractions recovered and the number of fractions recovered is determined by the size of the particles, the speed of rotation of the roller and belt speed, the thickness of the belt, its composition so as to reduce electrostatic effects, the intensity of the gradient as established by roller construction, and the location of reflector separators as shown in FIG. 3.

Because relatively high accumulations of heavy metals and coke precursors on the catalyst can block catalytic cracking sites, the invention preferably employs a catalyst having both a relatively high surface area and a relatively high pore volume. The high surface area provides places for adsorption of coke precursors and deposition of heavy metals without undue covering of cracking sites while the high pore volume makes blockage of pore passageways by these materials less likely. The surface area of the catalyst is preferably greater than 40 square meters per gram, and more preferably greater than 80 square meters per gram, and most preferably in the range of 80 to 250 square meters per gram. The pore volume of the catalyst is preferably greater than 0.2 cc/gm, more preferably at least 0.3 cc/gm and most preferably at least about 0.5 cc/gm.

The present invention further contemplates treating catalyst from the regenerator with a reducing gas so that the nickel on the catalyst is in a reduced state at the time the catalyst is passed through the magnetic field of the separator apparatus.

To ensure effective reduction of the nickel, carbon on the regenerated catalyst is preferably less than 0.25 weight percent, more preferably less than 0.1 weight percent, and most preferably less than 0.05 weight percent. Optimally effective magnetic separation of heavy metals laden catalyst particles requires deposited nickel levels substantially greater than 500 ppm and preferably greater than about 800 ppm. Accordingly, a preferred catalyst for practicing the invention comprises an equilibrium conversion catalyst having levels of deposited nickel of at least 1000 ppm, preferably at least 1500.

When the foregoing catalyst is passed through a regenerator to burn off deposited coke in the presence of an oxidizing gas, such as air, the nickel deposits on the catalyst are placed in an oxidized state. According to one preferred method of carrying out the present invention, catalyst is withdrawn from the regenerator and is treated with a reducing gas so that the nickel on the regenerated catalyst is in a reduced state at the time it is introduced into the magnetic field. Treatment of the regenerated catalyst with reducing gas may take place either in the regenerated, catalyst standpipe, in a separate vessel or system between the regenerated catalyst outlet of the regenerator and the magnetic separator. If an explosive reducing gas is used, care should be taken to prevent any backflow toward the regenerator of a component discharging gases to the regenerator, such as the regenerated catalyst stripper and portions of the regenerated catalyst standpipe upstream of the reducing vessel or zone. The amount of reducing gas used is preferably sufficient to provide almost a pure reducing atmosphere in contact with the nickel deposits on the catalyst.

The preferred reducing gases for practicing the invention include hydrogen, carbon monoxide, methane and/or natural gas. Because the gases specified are, except for carbon monoxide, explosive at regenerator conditions, it is preferable to use carbon monoxide as the reducing gas where there may be at least some backflow into the regenerator, such as when using the lower section of the regenerated catalyst standpipe as a reducing zone. In this arrangement, the carbon dioxide formed by the reduction reaction and the excess carbon monoxide over that consumed in the reduction reaction may pass back into the regenerator and be discharged from the system with the regenerator flue gases. A preferred source of carbon monoxide is the flue gas from the first stage of a two stage regenerator which is operated with an oxygen deficient first stage and a relatively high $CO/CO_2$ ratio as explained elsewhere in this specification.

Preferred sources of catalyst which has been both regenerated to remove coke and subsequently treated into a reducing gas to place the deposited nickel in a reduced state are disclosed in a PCT International Patent Application Ser. No. 00662, filed in the names of Ashland Oil, Inc. and entitled Steam Reforming of Carbo-Metallic Oils.

Figure 1:
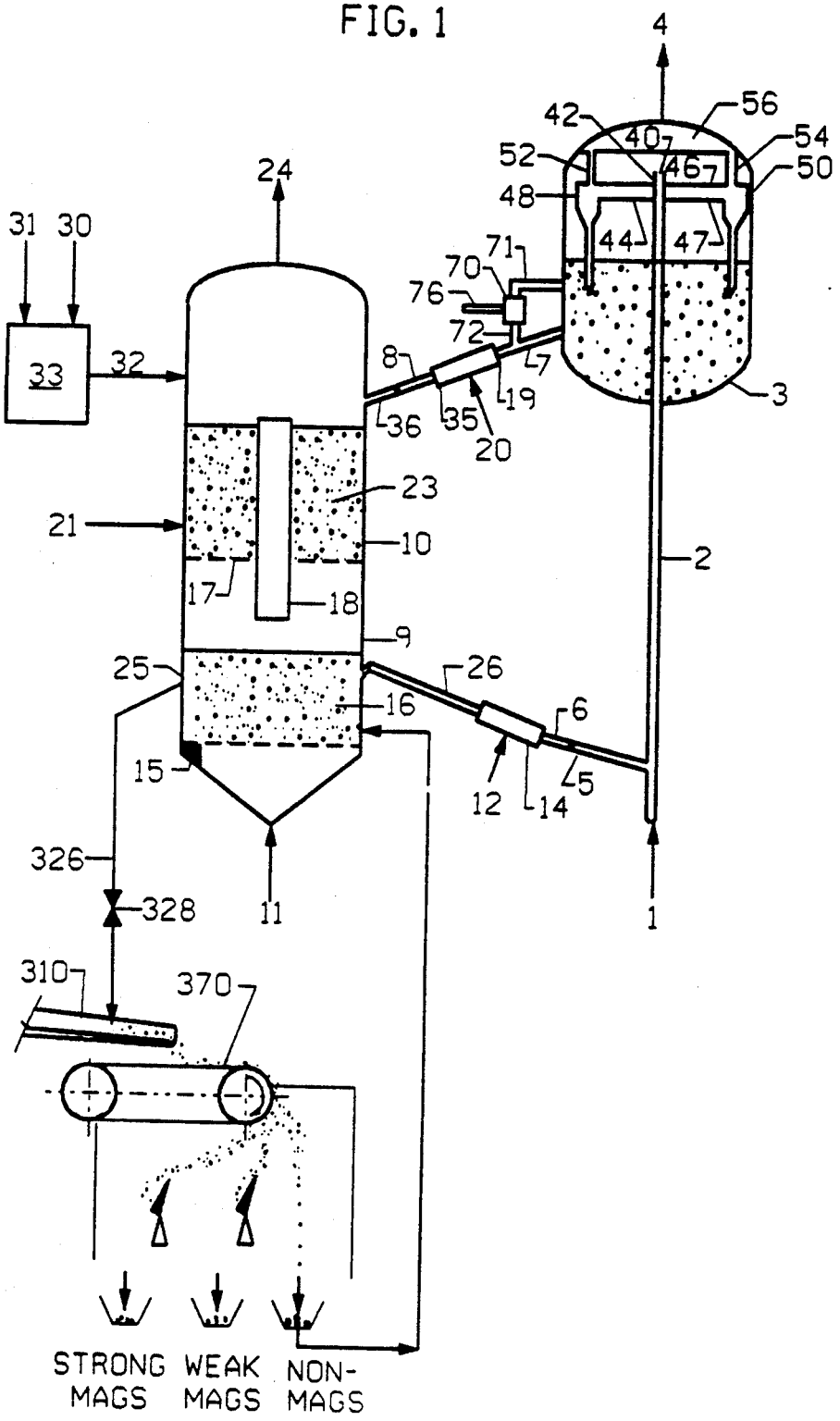
FIG. 1 is a schematic diagram of an apparatus for carrying out the process of the invention.

Referring in detail to FIG. 1 of the drawings, petroleum feedstock is introduced into the lower end of riser reactor 2 through inlet line 1, at which point it is mixed with hot regenerated catalyst coming through line 5 and stripper 14 from regenerator 9.

The feedstock is catalytically cracked in passing up riser 2 and the product vapors are ballistically separated from catalyst particles in vessel 3. Riser 2 is of the vented type having an open upper end 40 surrounded by a cup-like member 42 which preferably stops just below the upper end 40 of the riser so that the lip of the cup is slightly upstream of the open riser tube as shown in FIG. 1. A pair of product vapor lines 44, 46 communicate with the interior of the cup so as to discharge product vapors entering the cup from the vapor space of vessel 3. the cup forms an annulus 47 around and concentric to the upper end of the riser tube. The transverse cross-sectional area of annulus 47 is preferably in the range of 70 to 100% of the transverse cross-sectional area of riser tube 2. The structure causes product vapors to undergo a complete reversal in their direction of flow after they are discharged from the riser tube but before they leave the vapor space of vessel 3. The product vapors then make a further turn or change in direction of about 90° as they enter product lines 44 and 46. The product vapors then enter cyclone separators 48, 50 having overhead conduits 52, 54, respectively which convey the vapors to line 4 through a common header 56. The amount of particle carry over with this flow reversal structure may be reduced by a factor of about 5 or more relative to carry over with the basic vented riser arrangement described in U.S. Pat. Nos. 4,066,533 and 4,070,159. Due to this reduction in carry over, cyclone separators 48 and 50 may comprise only a singe cyclone stage instead of having multiple stages as usually required to prevent excessive carry over of catalyst fines into the overhead vapor line in prior vented riser applications.

The catalyst, contaminated with coke, is removed from separator vessel 3 and passed into stripper through line 7. Stripped catalyst is introduced into bed 23 in upper zone 10 of regenerated 9 through line 36. The rate of flow of catalyst into zone 10 is controlled by valve 8. A small stream of catalyst is removed from vessel 3 through line 71 to magnetic separator 70. That portion passing through the magnetic field is passed on to line 7 and the particles trapped in the magnetic field are removed and discarded through line 76.

Makeup catalyst, whether virgin or used, is introduced through lines 30 and 31 into solids feeder 33 and then through line 32. Oxidizing gas, such as air, is introduced into zone 10 through line 21. A portion of the coke on the catalyst is burned in zone 10 and the partially regenerated catalyst flows downwardly through conduit 18 into lower regeneration zone 25.

An oxidizing gas, such as air, is introduced into regeneration zone 25 through line 11. The oxidizing gas flows through gas distribution plate 15 and thus into the bed 16 or catalyst particles. This mixture passes upwardly through the bed 16 of coke-contaminated catalyst particles, fluidizing it as well as reacting with the coke, and passes through perforated plate 17 into the bed of catalyst particles in zone 10.

The perforations in the plate 17 are large enough so that the upwardly flowing gas readily passes there through into zone 10. During regeneration of the catalyst the pressure difference between the upper and lower zones prevents catalyst particles from passing downwardly through the plate. Gases within the regenerator comprising combustion products, nitrogen and 45 possibly additives for combustion control, such as steam and/or chlorine, are separated from suspended catalyst particles by a separator (not shown) and then pass out of the regenerator through line 24.

Regenerated catalyst is removed from zone 25 through conduit 26 for return to riser 2 through the stripper 14, the rate of removal being controlled by valve 6.

A stripping gas such as steam is introduced into stripper 19 through line 20 to remove volatiles from the catalyst. The volatiles pass from the stripper through line 7 into vessel 3 and then out through line 4. Similarly a stripper gas, such as steam is introduced into stripper 14 through line 12 to remove absorbed nitrogen from the regenerated catalyst before it is returned to the regenerated catalyst before it is returned to the reactor 2. The stripped gases pass through line 26 into the regenerator 9.

While this invention may be used with single stage regenerators, or with multiple stage regenerators having concurrent instead of countercurrent flow, it is especially useful in a regenerator of the type shown which is well-suited for producing gases having a high ratio of CO to $CO_2$.

In a preferred method of carrying out this invention in a countercurrent flow pattern, as in the apparatus of FIG. 1, the amount of oxidizing gas and catalyst are controlled so that the amount of oxidizing gas passing into zone 25 is greater than that required to convert all the coke on the catalyst in this zone to carbon dioxide, and the amount of flue gas passing upwardly from zone 25 into zone 10 together with the oxidizing gas added to zone 10 from line 21 is insufficient to convert all the coke in zone 10 to carbon dioxide. Zone 10 therefore will contain some CO.

A portion of the regenerated catalyst from zone 25 is removed through conduit 326 past valve 328 to spreader 310. It is understood that the conduit and valve 326 are schematic and may in fact involve a cooling process and/or a stripping process. Particulates removed through conduit 326 can be supplemented by a recycle discussed in more detail with respect to FIG. 3. The numbering in all Figures is consistent.

Figure 2:
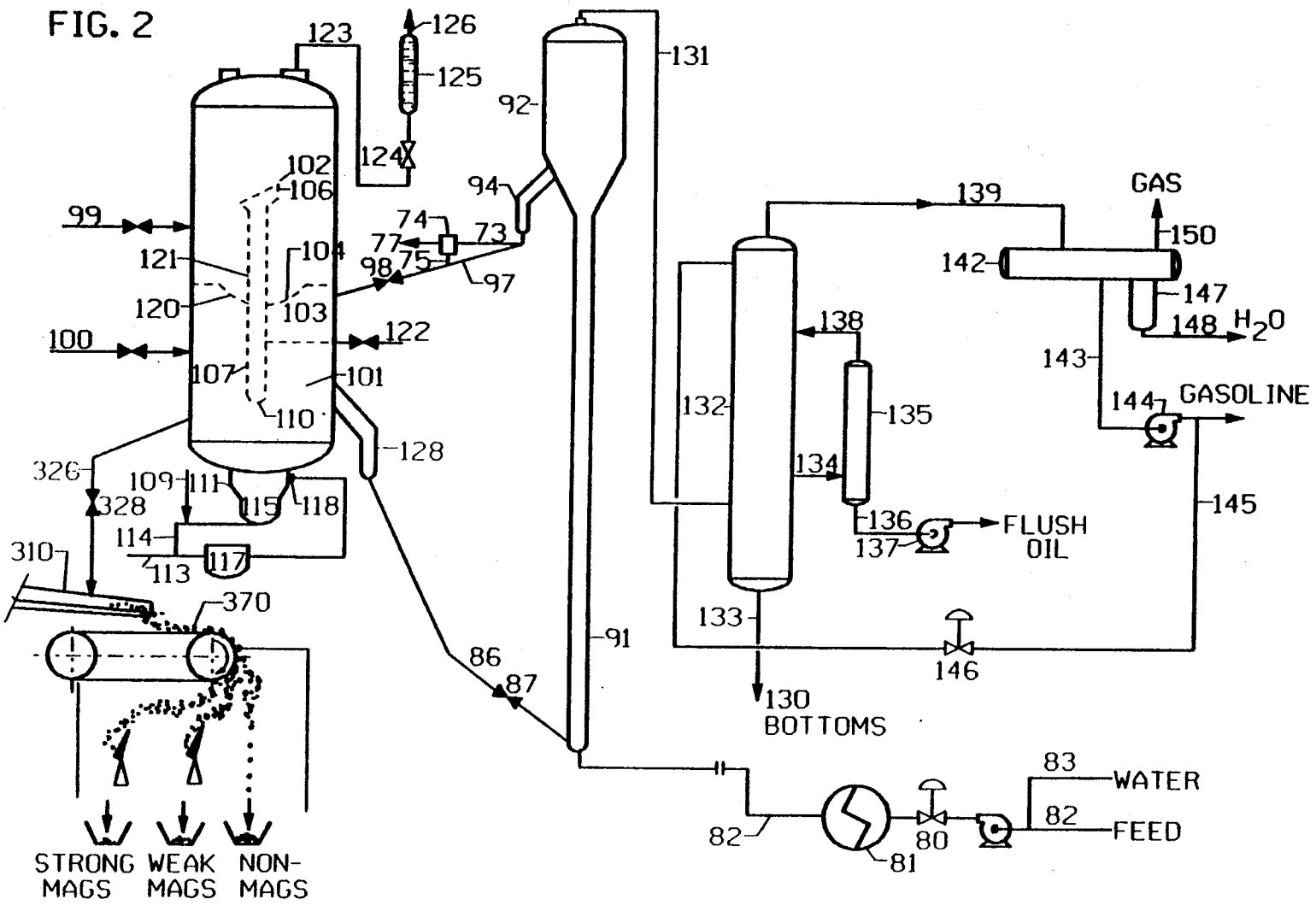
FIG. 2 is a schematic diagram of another apparatus for carrying out the process of the invention.

A particularly preferred embodiment is described in FIG. 2 where reference numeral 80 identifies a feed control valve in feedstock supply pipe 82. Supply pipe 83 (when used) introduces liquid water and/or an additive solution into the feed. Heat exchanger 81 in supply pipe 82 acts as a feed preheater, whereby preheated feed material may be delivered to the bottom of a riser type reactor 91. Catalyst is delivered to the reactor through catalyst standpipe 86, the flow of catalyst being regulated by a control valve 87 and suitable automatic control equipment (not shown) with which persons skilled in the art of designing and operating riser type cracking units are familiar.

The reactor is equipped with a disengagement vessel 92 similar to the disengagement vessel 3 of the reactor shown in FIG. 1. Catalyst departs disengagement vessel 92 through stripper 94. Spent catalyst passes from stripper 94 to regenerator 101 via spent catalyst transfer pipe 97 having a slide valve 98 for controlling flow.

A sidestream of catalyst is passed to distributor 310 through line 326. That portion passing through the magnetic field is returned to line 97 through a line not shown in the figure.

Regenerator 101 is divided into upper chamber 102 and lower chamber 103 by a divider panel 104 intermediate the upper and lower ends of the regenerator vessel. The spent catalyst from transfer pipe 97 enters upper chamber 102 in which the catalyst is partially regenerated. A funnel-like collector 106 having a biascut upper edge receives partially regenerated catalyst from the upper surface to the dense phase of catalyst in upper chamber 102 and delivers it, via drop let 107 having an outlet 110, beneath the upper surface of the dense phase of catalyst in lower chamber 103. Instead of internal catalyst drop leg 107, one may use an external drop leg. Valve means in such external drop leg can control the residence time and flow rate in and between the upper and lower chambers. Make up catalyst and/or catalyst or regenerator additives may be added to the upper chamber 102 and/or the lower chamber 103 through addition lines 99 and 100 respectively.

Air is supplied to the regenerator through an air supply pipe 113. A portion of the air travels through a branch supply pipe 114 to bayonet 115 which extends upwardly into the interior of plenum 111 along its central axis. Catalyst in chamber 103 has access to the space within plenum 111 between its walls and bayonet 115. A smaller bayonet (not shown) in the aforementioned space fluffs the catalyst and urges it upwardly toward a horizontally arranged ring distributor (not shown) adjacent the open top of plenum 111 where it opens into chamber 103. The remainder of the air passing through air supply pipe 113 may be heated in air heater 117 and is then introduced into inlet 118 of the ring distributor, which may be provided with holes, nozzles or other apertures which produce an upward flow of gas to fluidize the partially regenerated catalyst in chamber 103.

The air in chamber 103 completes the regeneration of the partially regenerated catalyst received via drop leg 107. The amount of air supplied is sufficient so that the resultant combustion gases are still able to support combustion upon reaching the top of chamber 103 and entering chamber 102. Drop leg 107 extends through an enlarged aperture in panel 104, to which is secured a gas distributor 120 which is concentric with and surrounds a drop leg. Combustion supporting gases from chamber 103, which have been partially depleted, are introduced via gas distributor 120 into upper regenerator chamber 102 where they contact incoming coked catalyst from coked catalyst transfer pipe 97. Apertured probes 121 in gas distributor 120 assist in achieving a uniform distribution of the partially depleted combustion supporting gas into upper chamber 102. Supplemental air or cooling fluids may be introduced into upper chamber 102 through a supply pipe 122, which may also discharge through gas distributor 120.

Fully regenerated catalyst with less than about 0.25% carbon, preferably less than about 0.1% and more preferably less than about 0.05%, is discharged from lower, regenerator chamber 103 through regenerated catalyst stripper 128, whose outlet feeds into catalyst standpipe 86. Thus, regenerated catalyst is returned to riser 91 for contact with additional fresh feed. The division of the regenerator into upper and lower regeneration chambers 102 and 103 not only smooths out variations in 30 catalyst regenerator residence time but is also uniquely of assistance in restricting the quantity of regeneration heat which is imparted to the fresh feed while yielding a regenerated catalyst with low levels of coke for return to the riser.

Because of the arrangement of the regenerator, coked catalyst from transfer line 97, with a relatively high loading of carbon, contacts in chamber 102 combustion supporting gases which have already been at least partially depleted of oxygen by the burning of carbon from partially regenerated catalyst in lower chamber 102. Because of this, it is possible to control both the combustion of carbon and the quantity of carbon dioxide produced in upper regeneration chamber 102. Although regenerating gas introduced through air supply pipe 113 and branch conduit 114 may contain relatively large quantities of oxygen, the partially regenerated catalyst which is contacts in lower chamber 103 has already had a major portion of its carbon removed. The high oxygen concentration and temperature in chamber 103 combine to rapidly remove the remaining carbon in the catalyst, thereby achieving a clean, regenerated catalyst with a minimum of heat release. Thus, here again, the combustion temperature and the ratio of $CO_2$ to CO in the lower chamber are readily controlled. The regeneration off gases are discharged from upper chamber 102 via gas pipe 123, regulator valve 124, catalyst fines trap 125 and outlet 126.

The vapor products from disengagement vessel 92 may be processed in any convenient manner such as by discharge through vapor line 131 to fractionator 132. Fractionator 132 includes a bottoms outlet 133, side outlet 134, flush oil stripper 135, and stripper bottom line 136 connected to pump 137 for discharging flush oil. Overhead product from stripper 135 returns to fractionator 132 via line 138.

The main overhead discharge line 139 of the fractionator is connected to an overhead receiver 142 having a bottoms line 143 feeding into pump 144 for discharging gasoline product. A portion of this product may be returned to the fractionator via recirculation line 145, the flow being controlled by valve 146. The receiver 142 also includes a water receiver 147 and a water discharge line 148. The gas outlet 150 of the overhead receiver discharges a stream which is mainly below C5, but containing some C5, C6 and C7 material. If desired, the C5 and above material in the gas stream may be separated by compression cooling and fractionation, and recycled to receiver 142.

The oxidizing gas, such as air, introduced into regeneration zone 103 through line 114 may be mixed with a cooling spray of water from a conduit 109. The mixture of oxidizing gas and atomized water flows through bayonet 115 and thus into the lower bed of catalyst particles.

The apertures in distributor 120 are large enough so that the upwardly flowing gas readily passes into zone 102. However, the perforations are sized so that the pressure difference between the upper and lower zones prevents catalyst particles from passing downwardly through the distributor. The bayonet 115 and distributor are similarly sized. Gases exiting the regenerator comprise combustion products, nitrogen, steam formed by combustion reactions and/or from vaporizing water added to the regenerator, and oxides of sulfur and other trace elements. These gases are separated from suspended catalyst particles by a cyclone separator (not shown) and then pass out of the regenerator through discharge conduit 123. While this invention may be used with single stage regenerators, or with multiple stage regenerators which have basically concurrent instead of countercurrent flow between combustion gases and catalyst, it is especially useful in regenerators of the type shown in FIGS. 1 and 2, which nave countercurrent flow and are well-suited for producing combustion product gases having a low ratio of $C0_2$ to CO, which helps lower regeneration temperatures in the presence of high carbon levels.

Figure 3:
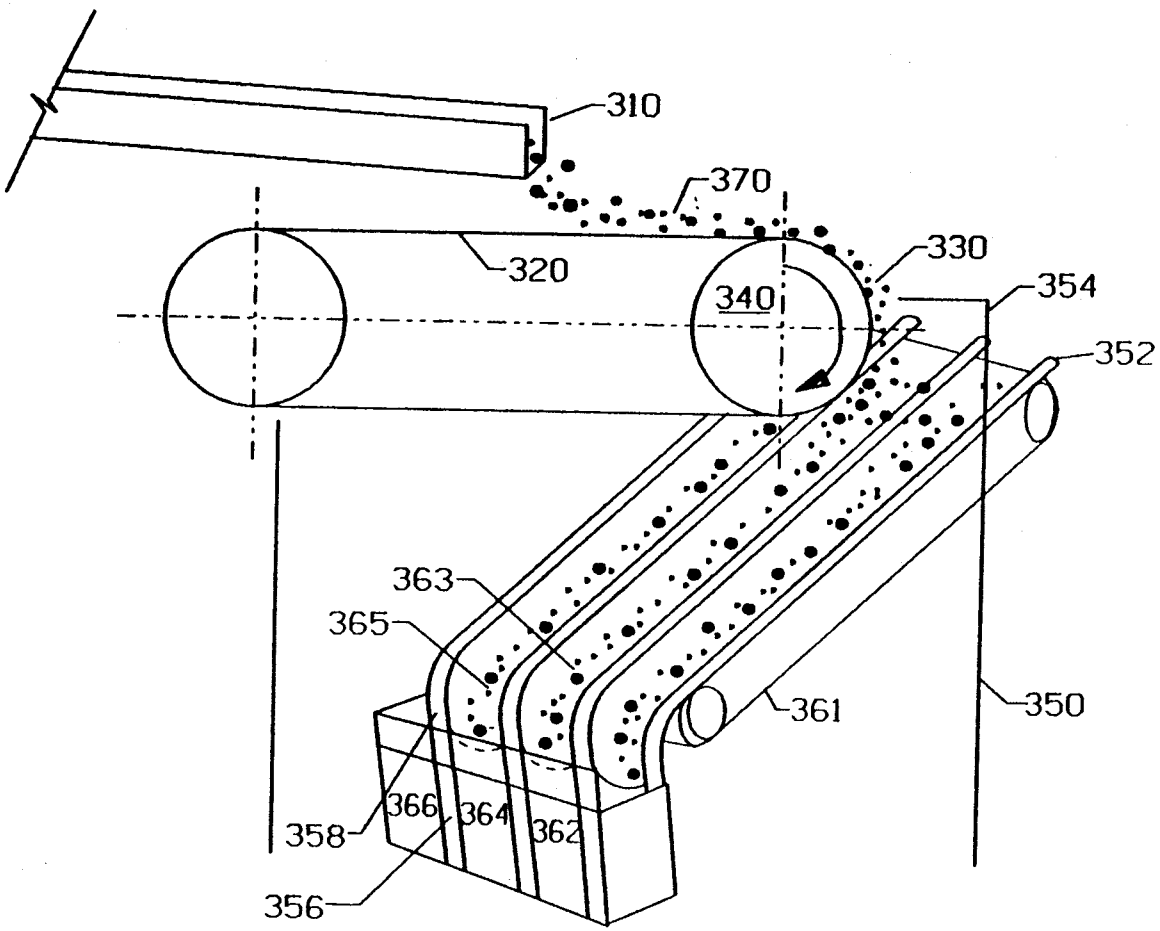
FIG. 3 is a schematic diagram of the magnetic separating device.

FIG. 3 discloses a schematic representation of the Rare Earth Roller Magnetic Separator ("RERMS") suitable for this invention. Shown are: a distributor 310, an electrostatic conductive conveyor belt 320, roller distribution point 330, magnetic roller 340, an isolation box 350 (preferably at a negative pressure to avoid dust), divider walls 352, 354, 356 and 358, transverse belts 361, 363 and 365, collection bins 362, 364 and 366, and particulate stream 370.

In operation, a particulate stream 370 of for example catalyst or sorbent, having an average particle size for example in the range 20 to 150 microns are distributed by spreader 310 uniformly over conveyor belt 320 to a thickness determined by metering out so many pounds per inch per hour. The preferred range generally of pounds per inch per hour is anywhere from ½ to 20, and preferably in the range of about 2 to 10 lbs/in/hr. Conveyor belt 330 moves at a linear velocity, for example, in the range of about 50 to 500 feet per minute, and preferably 80 to 300 feet per minute, but is adjusted so as to get a distribution after the roller distribution point 330 in isolation box 320. Within isolation box 350, preferably under a reduced pressure to avoid dust problems, there are a series of transverse belts 361, 363 and 365. Each belt has divider walls such as divider walls 352, 354, 356 and 358 to prevent transverse mixing of particulates from one belt to the other, and to ensure cleaner cut of the distribution created by belt 320 after distribution point 330. Each belt transports particulates in a direction that is transverse to that direction established by conveyor belt 320. Each belt can empty for example into a particular collection bin. Examples of collection bins are 362, 364 and 366. More or less transverse belts may be used. However, it has been found particularly advantageous to increase the number of belts so as to take advantage of the distribution of particulates produced after the distribution point 330. Preferably there are at least two such belts employed. Transverse belt 361 and bin 362 could be simply a bin.

It is within the intent of this invention, that one or more transverse belts can themselves be RERMS and instead, for example, having collection bins at the end of these belts there is still another transverse belt such as transverse belt 320. In this manner, multiple separations can be obtained on a single pass. More usually after a period of time, one or more groups of particulates contained in one or more collection bins 362, 363 and 366 can be recycled. Preferably recycle is a continuous process, wherein the contents of for example bin 362 is recycled back to distributor 310. In general, at least two cuts must be established before each recycle begins to optimally produce a cumulatively significant difference in metals level and corresponding activity or adsorpitivity.

In FIG. 3, clearly the most magnetically susceptible particulates will be transferred to bin 366 staying nearest the conveyor belt for the longest period of time. Somewhat less magnetically susceptible particulates will be contained within bin 364. And finally, the least or non-magnetic particulates will be contained in bin 362. By running the process in a continuous manner with recycle, wherein the contents of bin 362 is recycled back to distributor 310 along with newly regenerated particulates, the metals content differentiation between the contents of bins 366, 364 and 362 become more and more pronounced.

It is within the contemplation of this invention to also partially recycle the contents of bin 364 along with all of the contents of 362. For example, we have found recycling all of bin 362, and up to 50% of bin 364 in a series of recycles yields results similar to those reported in the Examples.

Where there is a significant fraction, e.g. at least 50% by weight, of large particles, e.g. of about 90 microns and above in a distribution ranging from about 20 microns to 250 microns, the adverse impact on separation efficiency due to differences in inertial forces is preferably taken into account by means of a separation by a non-magnetic separation prior to subjecting a particulate stream to a RERMS. Such initial separation based primarily on size tends to improve later separations in a RERMS, all other factors remaining constant.

Having thus described this invention, the following Examples are offered to illustrate the invention in more detail.

EXAMPLE 1

A carbometallic feed, with an API° gravity of 15, is introduced at a temperature of about 250° F. at a rate of 30,340 B/D into the bottom zone of a vented riser reactor where it is mixed with lift gas and a zeolite containing catalyst at a temperature of about 1320° F. The catalyst to oil ratio is about 8:1.

The carbometallic feed has a heavy metal content of about 7 parts per million of nickel equivalents, which is comprised of about 5 ppm nickel and about 9 ppm vanadium. This feed has a sulfur content of about 2.6% and a Ramsbottom carbon content of 3.9%.

The temperature at the reactor effluent is about 975° F., and the pressure is about 30 psia.

Within the riser about 69.2% volume of the feed is converted to fractions boiling at a temperature less than 430° F., and about 50.3% volume of the feed is converted to gasoline with a research octane number of 93.5. During the conversion, 9.8% of the feed is converted to coke, and 16.4 vol. % is converted to 430°-630° F. endpoint light cycle oil.

The catalyst containing about 1.27% by weight of coke and about 0.01% sulfur is removed from the reactor where it is contacted with steam at a temperature of about 1000° F. to remove volatiles adsorbed onto the catalyst.

This spent and stripped catalyst is then introduced into the upper zone of a two-stage regenerator as shown in FIG. 1.

Each regenerator zone contains about 200 tons of catalyst for a total catalyst inventory of about 400 tons. Air is introduced into the lower zone to burn off remaining carbon, and produces mainly $CO_2$, with very little CO being formed at a temperature of about 1330° F.

Air is also introduced into the upper zone together with flue gases from the lower zone. The upper zone produced more $CO_2$ and CO at a temperature of about 1330° F. The regenerator flue gases contain $CO_2$ and CO in a mol ratio of 4. The catalyst removed from the lower zone recycled to the reactor riser contains about 0.05% coke by weight.

A side stream of regenerated catalyst having a MAT relative activity of 20 and a total heavy metal content of 3,200 ppm Nickel equivalents is withdrawn for magnetic separation, and the remainder of the regenerated catalyst is returned to the reactor.

The side stream of regenerated catalyst is sent to an Eriez Magnetics, Rare Earth Roll Permanent Magnetic Separator, RERPMS, where it is split into several fractions as shown in FIG. 3. Non-magnetic fraction #1 representing 25 wt. % of feed contains 2800 ppm of nickel equivalents, a surface area of 108 $M^2$/gm and a MAT relative activity of 30. Non-magnetic fraction #2, 15.4 wt. %, which is sent to chemical reactivation, contains 3200 ppm of nickel equivalents and a surface area of 91 $M^2$/gm.

This fraction is sent to chemical reactivation processing for return to the unit.

Magnetic faction #3, representing 24 wt. % contains 3300 ppm of nickel equivalents, a surface area of 80 $M^2$/gm and a MAT relative activity of 20 is sent to disposal.

In this operation, a non-conducting belt was used, resulting in loss of 32 wt. % due to electrostatic interference and retention. This fraction is also collected and has properties similar to the magnetic fraction, having a nickel equivalent of 3600 ppm and a surface area of 83 $M^2$/gm. This fraction and fraction #3 are discarded or sent to chemical processing for metals recovery.

This rare earth roller permanent magnet separator has a magnetic strength of 16,000 gauss, with high gradient as high as 3 MM $m^{-1}$ and is a new design in which the separator roll is a roll consisting of disks of Sm—Co, or Nb—Fe—B permanent magnets interleaved with mild steel disks. The most favorable ratio of the widths of the magnet and of the steel insert is 4:1. Mild steel insert given the most satisfactory results and special steels usually do not improve the performance of the separator. The magnet in this configuration generates magnetic induction up to 1.6 T Tesla (1 Tesla = 10,000 Gauss) on the surface of the roll and field gradients of the order of 300 T $m^{-1}$ (Tesla per meter). For an easy removal of magnetic particles, the roll is covered by a thin belt supported by a second (idler) roll. As shown schematically in FIG. 3. Below the conveyor is a hopper which collects the discharging material while adjustable splitters divert the different fractions into collection pans placed beneath the hopper.

For comparison the side stream of regenerated catalyst is sent to an Eriez Magnetics High Gradient Magnetic Separator HGMS, in a magnetic field of 20,000 Gauss. Here because of restrictions on loading, only small fractions of magnetic material can be collected, relative to the total mass passed through the unit. At an air carrier rate of 3.6 m/second, 3% of magnetic regenerated catalyst was recovered with a metals equivalent of 4200, and a 97% non-magnetic fraction with a 2600 metal equivalents.

These results indicate the limitations of HGMS processing versus RERPMS processing, in that only small cuts can be taken with difficulty in separation of large fractions.

In an effort to obtain similar results to the RERPMS operation, catalyst in fluidized or flowing form was slowly passed through the HGMS field, with two fractions of non-magnetic material being collected, and finally the magnet was deactivated to release the magnetic fraction from the matrix and a magnetic fraction was obtained. The first portion of non-magnetic material 52 wt. % had a metals equivalent content of 3200 ppm and a MAT relative activity of 25. A second portion 42% had a 3900 ppm metals equivalent but a MAT activity of 20. Only 6% of magnetic material was recovered with a metals equivalent of 4000. These results indicate the greater degree of effectiveness and flexibility of the RERPMS.

EXAMPLE 2

Under similar process operating conditions a new process modification was introduced utilizing a conducting carrier belt so as to eliminate electrostatic charge, and thus avoiding the losses reported in Example 1 due to electrostatic effects. Slip stream regenerated catalyst from the regenerator was passed over a roll and three cuts made, two repasses non magnetic portion, a mid cut portion, and magnetic portion subjected to four repasses.

Table 1 shows the results of this operation.

TABLE 1

| | Catalyst Regenerated RCC Catalyst 2800 ppm Nickel Equivalent | | |
|---|---|---|---|
| | Non Mag | Mid Cut | Mag |
| Yield % | 11 | 38 | 51 |
| Surface Area $M^2$/gm | 97 | 94 | 84 |
| % C | 0.07 | 0.06 | 0.05 |
| Nickel Equiv. | 2700 | 2800 | 3400 |

As can be seen, 51 wt. % of magnetic catalyst was recovered with a surface area of 84 $M^2$/gm. which correlates to a MAT relative activity of 11 and a metals equivalent of 3400 compared and 11% yield of a non magnetic material of 97 $M^2$/gm. MAT relative activity of 23 and a metals equivalent of 2700.

Not only was separation effective, but because of the introduction of an electrostatic removing belt the intermediate fraction of 38 wt. % was easily collected for submission to chemical reactivation and operating costs for the RERPMS because of the use of a permanent magnet is considerably less than that involved in supplying current to generate an electro magnet for the HGMS- Eriez Unit.

EXAMPLE 3

A carbometallic oil feed with an °API gravity of 16.1, is introduced at a temperature of 268° F., at a rate of 31,900 B/D into the bottom zone of a vented riser reactor where it is mixed with lift gas and zeolite containing catalyst FOC-90 at a temperature of about 1332° F. and exiting the reactor at 975° F. The catalyst to oil ratio is 7.5/1. and the total pressure 30 psia.

This feed has a heavy metals content of 8 ppm of nickel equivalents (excluding iron) which is composed of 6 ppm of nickel and 8 ppm of vanadium. The feed has a sulfur content of 2.6 wt. % and a Ramsbottom Carbon of 3.9 wt. %.

Within the riser about 68.8% conversion of the feed boiling below 430° F. is achieved and about 50.3 vol % gasoline is obtained with a research octane number of 93.3, and 9.7 wt. % of the feed is converted to coke. Overall there is a 104.5 vol. % yield of liquid products or equivalents. The spent catalyst contains 1.35 wt. % coke and the regenerated catalyst has a surface area of 93 $M^2$/gm.

A side stream of spent catalyst having a surface area of 94 $M^2$/gm and a nickel equivalent content including iron of 3150 ppm is withdrawn before regeneration, and subjected to magnetic separation. See FIG. 3. The withdrawn catalyst is split into three fractions, 23 wt. % of low magnetic catalyst with a surface area of 107 $M^2$/gm. and a metals equivalent of 2700 and recycled back to the unit. 40 wt. % of mid cut catalyst is also withdrawn and regenerated and subjected to chemical reactivation. Its metal equivalent is 3070. 37 wt. % of the catalyst is removed as magnetic product after 5 repasses and disposed of. This material has a surface area of 83 $M^2$/gm, and a metals equivalent of 3700.

TABLE II

| | Spent Catalyst RCC Catalyst 1.35% coke on catalyst | | |
|---|---|---|---|
| | Non Mag | Mid Cut | Mag |
| Yield % | 23 | 40 | 37 |
| Surface Area | 107 | 92 | 83 |
| % C | 1.21 | 1.08 | 0.97 |
| Nickel Equiv. | 2700 | 3070 | 3700 |

As can be seen, there is an appreciable greater surface area separation and metal equivalents for the carbon laden reduced, spent catalyst as compared to regenerated catalyst. Compare with Table I.

EXAMPLE 4

The RERPMS can also be used very effectively on very low or inactive sorbent or particulates, where the objective is to remove very large mumants of metal and Ramsbottom Carbon from a carbometallic oil.

29,910 B/D of carbometallic oil with a gravity of 11.8°API, 47.9% boiling over 1000° F., a sulfur content of 3.1 wt. %, a Ramsbottom carbon content of 7.3 wt. %, a nickel equivalent, excluding iron of 20 ppm, which represents 13 ppm of nickel and 34 ppm of vanadium was fed at 328° F. to an ART unit, also designed to treat residual fractions at a sorbent to oil ratio of 4.2 over a non-zeolite containing particulate, at a particulate inlet temperature of 1480° F., and an outlet temperature of 925° F.

The upper regenerator temperature was at 1533° F. and conversion to 430° F. minus was 23.2 vol. %. Gasoline yield was 8.8 vol. % and 430°-630° F. vol. % was 20.7%. The regenerated side stream was taken to an RERPMS for splitting into similar fractions. The regenerated art CAT contained 7900 ppm of iron, 3030 ppm of nickel, and 10,200 ppm of vanadium.

Table III shows the results obtained with this method of separation.

TABLE III

| | Regenerated Non Mag | ART CAT Mid Cut | ART CAT Mag Cut | Process |
|---|---|---|---|---|
| % yield | 31 | 51 | 37 | spread |
| Surface area | 5 | 5 | 2 | between |

TABLE III-continued

| | Regenerated Non Mag | ART CAT Mid Cut | ART CAT Mag Cut | Process |
|---|---|---|---|---|
| % C | 0.12 | 0.20 | 0.46 | NM and M Cut |
| ppm Ni | 2700 | 3200 | 3700 | 1000 |
| ppm Fe | 6400 | 7300 | 10400 | 4000 |
| ppm V | 7800 | 9600 | 14300 | 6500 |
| Ni Equiv. | 5200 | 6200 | 8100 | 11500 |

Non-magnetic ART CAT is recycled to the ART unit, the mid cut can be sent for chemical clean up to remove metals and returned to the limit, and the high magnetic fraction treated separately for metals recovery and discarded. In this case the RERMS-Eriez unit can also be operated so as to only produce two cuts, a low metals fraction for recycle, and a high metals fraction for disposal or metals recovery. Note that there is a 1.15 wt. % metal difference between non magnetic and magnetic fractions.

EXAMPLE 5

Processing Temperature

Figure 4:
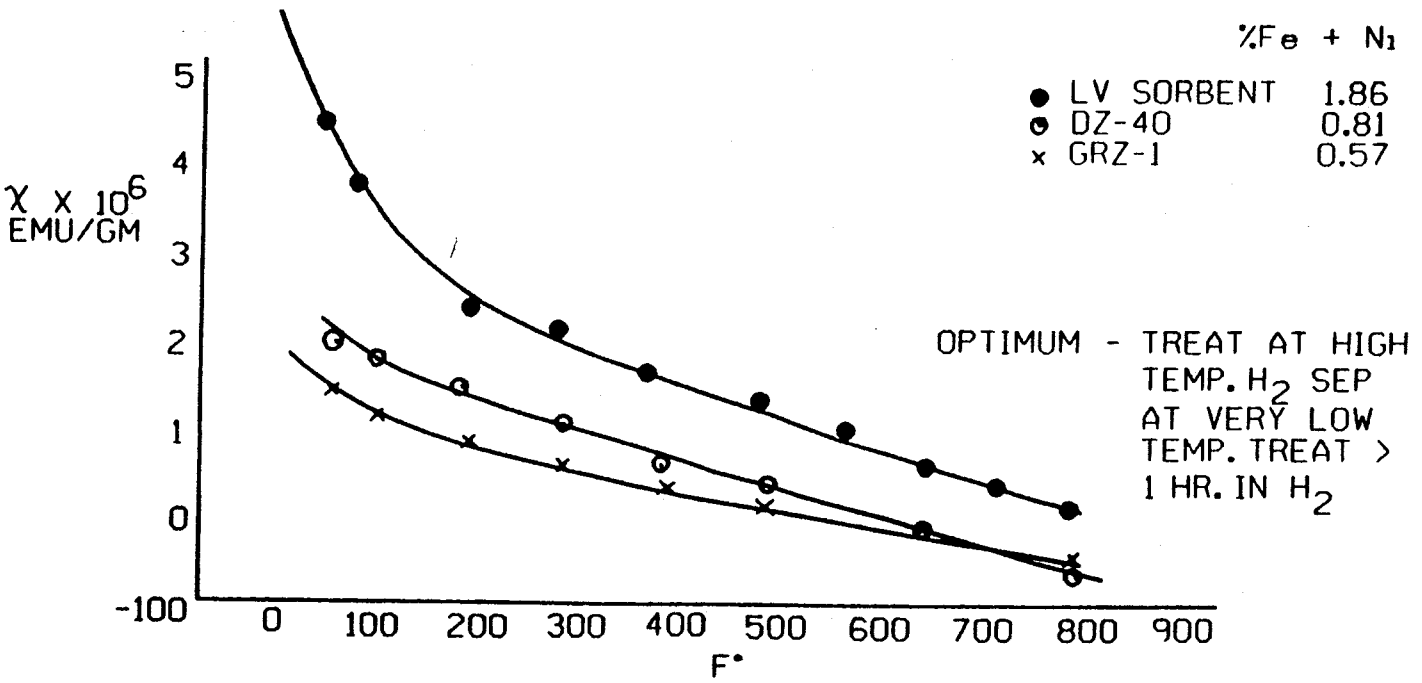
FIG. 4 is a graph showing magnetic susceptibility versus temperature or a series of different materials discussed in Example 5.

Processing conditions are also critical. Because of the nature of metals deposition on catalysts and sorbents, metal crystallites of nickel and iron tend to be quite small. Small crystallites of nickel lose their ferromagnetic properties at much lower temperatures than do large crystallites, passing through a Curie temperature at very low temperatures am shown by Selwood, et.al. JACS 77, 1462, 1954, entitled, "Thermomagnetic Analysis of Supported Nickel Catalysts." Studies of magnetic susceptibility as a function of temperature have been made on high metals containing catalyst confirming a rapidly increasing magnetic susceptibility as temperature is lowered. Table IV shows the composition of three high metals loaded catalysts and sorbent that were evaluated for magnetic susceptibility at various temperatures and FIG. 4 presents a plot of magnetic susceptibility.

TABLE IV

| Sample | % Fe | % Ni | % V |
|---|---|---|---|
| GRZ-1 (RDA 6661) | 0.29 | 0.28 | 1.34 |
| DZ-40 (RDA 7994) | 0.57 | 0.24 | 0.51 |
| Louis. Sorbent (RDA 8506) | 1.43 | 0.43 | 1.89 |

Shown in Table V. It is quite apparent from this data that magnetic susceptibility which relates directly to ease of magnetic separation increases rapidly as temperature is reduced below 200° F., and can be extremely high below 0° F. For enhanced operation then it is important that either spent or regenerated catalyst which exists at very high temperatures, must be cooled below 200° F., preferably 100° F., and most preferably to 0° F. for enhanced separation.

TABLE V

Effect of Temperature on Magnetic Susceptibility

| | Sample $X \times 10^{-6}$ (emu/g) | | |
|---|---|---|---|
| Temp (°F.) | DZ-40 | Sorbent | GRZ-1 |
| 77 | 1.57 | 4.59 | 2.22 |
| 122 | 1.41 | 3.98 | 2.06 |
| 212 | 1.23 | 2.62 | 1.68 |
| 302 | 1.06 | 2.49 | 1.48 |
| 392 | 0.92 | 2.13 | 1.15 |

TABLE V-continued

| Effect of Temperature on Magnetic Susceptibility | | | |
|---|---|---|---|
| | Sample $X \times 10^{-6}$ (emu/g) | | |
| Temp (°F.) | DZ-40 | Sorbent | GRZ-1 |
| 482 | 0.78 | 1.84 | 0.96 |
| 572 | 0.65 | 1.58 | 0.78 |
| 662 | 0.54 | 1.11 | 0.58 |
| 752 | 0.45 | 0.89 | 0.38 |
| 842 | 0.35 | 0.74 | 0.18 |
| 932 | 0.28 | 0.58 | 0.03 |

EXAMPLE 6

Catalyst Conditioning

While results shown in Tables I through III and examples 1 to 5 clearly show that catalysts exiting from the reactor or regenerator and processed at ambient temperature are readily separated, and that the lower the temperature of magnetic processing the greater the susceptibility, there are other means which may be utilized to increase the presence of ferromagnetic material with increased effective separation characteristics. By heating in $H_2$ at higher temperatures and times, greater reduction of nickel and iron ions to metallic nickel and iron is effective, and an increase in crystallite size with higher ferromagnetic properties and higher Curie temperatures further enhance magnetic susceptibility and thereby separation efficiency. Table VI shows the results of treating the same spent metal loaded catalysts at higher temperatures. Table VI shows how rapidly magnetic susceptibility increases with increasing temperature in the presence of reducing $H_2$. All samples were held for ½ hours at temperature. Further increasing of time at a given temperature results in even greater increase in susceptibility, especially at the lower temperatures. The data clearly shows that by treatment of spent or regenerated catalyst or ART, CAT sorbent at normal exiting regeneration temperatures, that $H_2$ treatment at these temperatures prior to cooling can greatly enhance magnetic separability.

TABLE VI

| Effect of Reduction in $H_2$ on Magnetic Susceptibility | | |
|---|---|---|
| Sample | Reduction Temp (°F.) | $X \times 10$ emu/g |
| GRZ-1 | | 2.29* |
| | 572 | 2.17 |
| | 752 | 4.45 |
| | 932 | 8.37 |
| DZ-40 | | 1.54* |
| | 572 | 1.55 |
| | 752 | 1.93 |
| | 932 | 4.09 |
| Louisville Sorbent | | 4.81* |
| | 572 | 4.78 |
| | 752 | 12.5 |
| | 932 | 23.3 |

*Magnetic susceptibility of sample in the "as received" state.

Reaction time in $H_2$=0.5 hr.—All magnetic susceptibility measurement were taken at room temperature.

Figure 5:
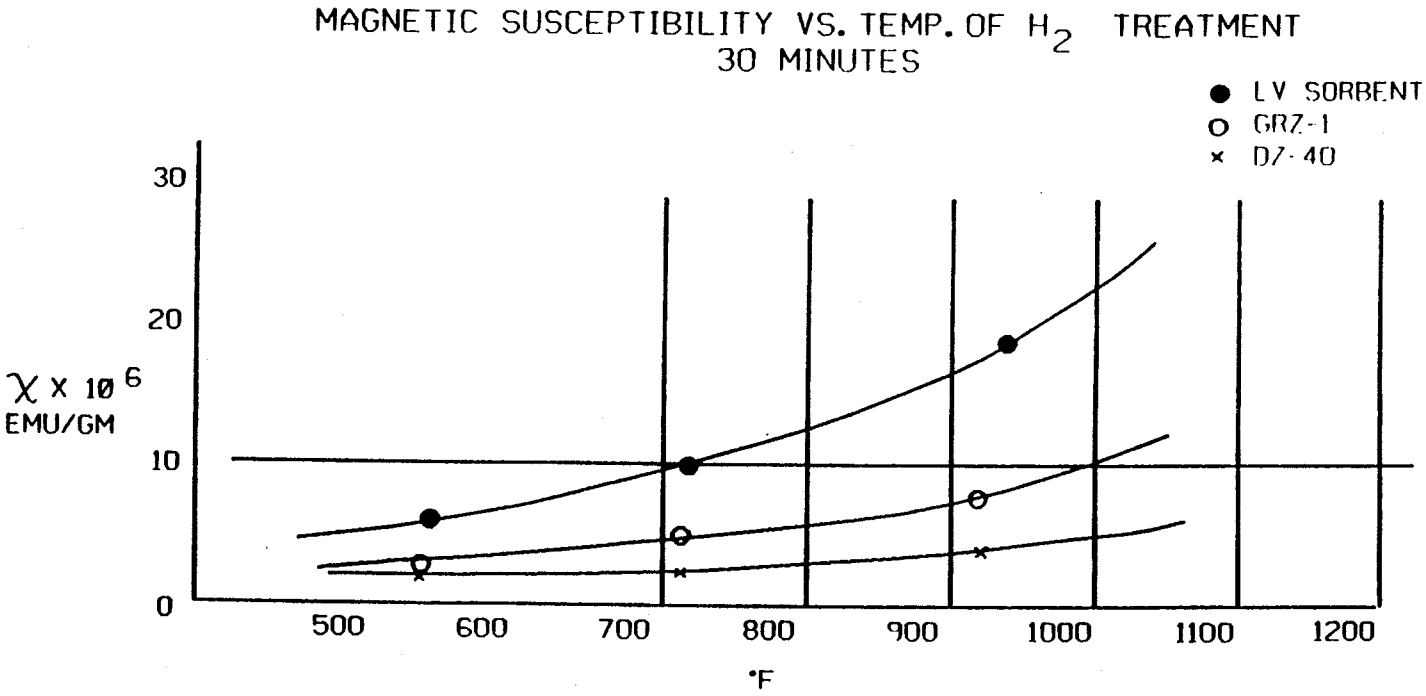
FIG. 5 (discussed in Example 6) shows the relationship between magnetic susceptibility versus temperature of a reduction treatment involving hydrogen for a fixed period of time for 30 minutes.

These results are shown in FIG. 5.

EXAMPLE 7

This example is a demonstration of magnetic separation employing increasing magnetic field strength as one goes from one roller magnetic separator to another.

100 lbs. of equilibrium cracking catalyst having a metals level of 2500 ppm nickel; 7000 ppm vanadium; and 8900 ppm iron with a particle size in the range of 53 to 212 microns with an average particle size of 114 microns was separated by passing at a rate of 10 lbs/inch of belt width/hour with the belt moving at a rate over the ferrite rolls of 129 feet per minute, and over the rare earth magnetic rolls, 308 feet per minute. On each pass over a roller, a magnetic and a non-magnetic portion resulted. It was the non-magnetic portion from each separation which was in turn used in the subsequent passage over the next magnetic roll.

In the following Table VII are the sequence of magnetic rolls used and the percentage of magnetic and non-magnetic material which resulted in passage over each successive roll. Recall that the material put over each successive roll constituted that fraction of material separated in the earilier separation and found to be non-magnetic.

TABLE VII

| | Magnetic Field Strength | Percent Non-Magnetic Material Separated | Percent Magnetic Material Separated |
|---|---|---|---|
| Roll 1 | ferrite magnetic roll −3 KG | not measured | not measured |
| Roll 2 | ferrite magnetic roll −2 KG | 84% | 16% |
| Roll 3 | rare earth magnetic roll 12.6 KG | not measured | not measured |
| Roll 4 | rare earth magnetic roll 12.6 KG | 51% | 31% |

TABLE VIII

| | |
|---|---|
| Feed | 2500 ppm Ni |
| | 7000 ppm V |
| | 8900 ppm Fe |
| Cut #1 16% | 2600 ppm Ni |
| | 6800 ppm V |
| | 10,200 ppm Fe |
| Cut #2 31% | 2700 ppm Ni |
| | 7200 ppm V |
| | 9000 ppm Fe |
| Cut #3 51% | 2100 ppm Ni |
| | 6700 ppm V |
| | 7300 ppm Fe |

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein. Reference to any publication, whether a patent or otherwise, is intended to expressly incorporate by reference such publication including any patents also referenced therein.

What is claimed is:

1. In a process for economically converting carbometallic oils to lighter products in a system comprising a progressive-flow reactor and a particulate regenerator comprising:

a. providing a converter feed containing metal(s);

b. bringing said converter feed together with inorganic particulate matter to form a stream comprising a suspension of said particulates in said feed and causing the resultant stream to flow through a progressive flow reactor having an elongated reaction chamber;

c. separating spent, coke-laden particulates from the stream of hydrocarbons formed by vaporized feed and resultant cracking products;

d. maintaining, in one or more regeneration zones, one or more fluidized particulate regeneration beds comprising spent particulates undergoing regeneration by combustion of the coke with oxygen on the spent particulate and supplying additional spent particulates to one or more of such fluidized regeneration bed or beds;

e. retaining said particles in said regeneration zone or zones in contact with a flow of said combustion—supporting gas under conditions of temperature, atmosphere and average total residence time in said zone or zones sufficient for combustion of the coke on the particulates and for reducing the level of carbon on the particulates while forming gaseous combustion product gases comprising CO and/or $CO_2$;

f. recycling the regenerated particulates to the reactor for contact with fresh feed;

the improvement comprising;

g. withdrawing a portion of the particulates from the cycle, said portion including particulates of relatively high activity and low metals and particulates of relatively low activity and high metals;

h. spreading withdrawn particulates over a conducting moving belt which eliminates electrostatic charge and which passes over a rotating roll containing a high intensity magnet so arranged in spacing and orientation so as to create high magnetic field gradients, having sufficient magnetic strength and belt speed so as to discharge, a first portion of low magnetic propertied particulates in one container, and a second retained higher magnetic propertied portion of particulates into a second container, whereby the first portion of particulates is higher in activity and lower in metals content then the second portion of particulates.

2. A process according to claim 1, wherein the particulate charged to the reactor comprises an accumulation of heavy metal(s) on said particulate derived from prior contact under conversion conditions with carbometallic oil, said accumulation including about 1000 ppm to about 30,000 ppm of Nickel Equivalents of heavy metal(s) and/or metal compound(s) measured on regenerated equilibrium catalyst.

3. A process according to claim 1, wherein the particulate charged to the reactor is a zeolite molecular sieve catalyst containing at least about 5% by weight of sieve.

4. A process according to claim 1, wherein the feed contains 650° F.+material which has not been hydrotreated and is characterized in part by containing at least about 5.5 parts per million of Nickel Equivalents of heavy metal(s), present in the form of elemental metal(s) and/or metal compound(s), said feed being brought together with said particulates and with additional gaseous material including steam whereby the resultant suspension of particulates and feed also includes gaseous material wherein the ratio of the partial pressure of the added gaseous material relative to the partial pressure of the feed is in the range of about 0.25 to about 4.0, and the vapor residence time of feed and products in the reactor is in the range of about 0.5 to about 3 seconds.

5. A process according to claim 1, wherein said 650° F.+material represents at least about 70% by volume of said feed and includes at least 10% by volume of material which will not boil below about 1000° F.

6. A process according to claim 1, wherein the carbon residue of the feed as a whole corresponds with a Conradson carbon value in the range of about 2 to about 12.

7. A process according to claim 1, wherein the feed as a whole contains at least about 4 parts per million of Nickel Equivalents of heavy metal present in the form of elemental metal(s) and/or metal compound(s), of which heavy metal(s) at least about 2 parts per million is nickel.

8. A process according to claim 1, wherein the regeneration is conducted in a plurality of regeneration zones.

9. The process of claim 1, wherein the withdrawn particulates are subjected to a reducing atmosphere before being passed through said magnetic field.

10. The process of claim 1, wherein the withdrawn catalyst is passed through the magnetic field as substantially fluidizable dry particles.

11. The process of claim 1, wherein the magnetic field strength is in the range from about 1 KG to about 25 KG.

12. The process of claim 1, wherein the strength of the magnetic field is in the range from about 21 KG to about 25 KG.

13. The process of claim 1, wherein the withdrawn catalyst is passed through a series of magnetic separators.

14. The process of claim 1, wherein the withdrawn catalyst is passed through a series of magnetic separators of successively increasing strength.

15. The process of claim 14, wherein said increasing strength from magnet to magnet is in at least one instance at least 5 KG.

16. The process of claim 15, wherein the series of magnetic separators increases in strength from about 5 KG to about 20 KG.

17. The process of claim 1, wherein the activity of catalyst separated into at least two portions, one non-magnetic and the other magnetic, said non-magnetic portion has at least 20 percentage points MAT relative activity in excess of that MAT relative activity of said magnetic portion.

18. A process according to claim 1, wherein the withdrawn particulates are regenerated catalyst containing deposited nickel in at least a partially oxidized state, said regenerated, withdrawn catalyst is contacted with a reducing gas under reducing conditions sufficient to reduce at least a portion of the oxidized nickel to a reduced state, and the resulting catalyst containing reduced nickel is passed through said magnetic separator.

19. A process according to claim 1, wherein at least a portion of the catalyst withdrawn in step (g) is withdrawn from a point downstream from said reactor and upstream from at least one of said regeneration zones.

20. A process according to claim 1, wherein the magnetic separator utilizes neodymium boron-iron alloy magnets of high magnetic strength.

21. A process according to claim 1, wherein said magnetic strength is at least 10 KG.

22. A process according to claim 1, wherein the magnetic separator utilizes a rare earth cobalt magnet of high magnetic strength.

23. A process of claim 1, wherein said roll contains a ferrite magnet.

24. A process according to claim 1, wherein said belt moves at a rate of one foot/minute to 1000 ft/minute.

25. A process according to claim 1, wherein the particulate material is an inert low surface area sorbent.

26. A process according to claim 1, wherein the particulate material is an active zeolite containing catalyst.

27. A processing according to claim 1; wherein the moving belt is a conducting electrostatic eliminating belt.

28. A process according to claim 1, wherein the particulates are between about 20 and 250 microns in diameter.

29. A process according to claim 1, wherein the particulates are cooled to less than 200° F.

30. A process according to claim 1, wherein the particulates are treated in $H_2$ above 700° F.

31. A process according to claim 1 wherein the particulates are split into at least three portions, a low, intermediate, and high metals containing fraction.

32. A process according to claim 1, wherein the low metals particulates are recycled back to said reactor and the high metals portion is discarded or processed for metal recovery.

33. The process of claim 24, wherein said belt moves at a rate of 5 to 350 feet/minute.

34. The process of claim 1, wherein said spreading is at ½ to 30 lbs/inch of belt width/hr.

35. The process of claim 34, wherein said spreading is at 2 to 20 lbs/inch of belt width/hr.

* * * * *

UNITED STATES PATENT AND TRADEMARK OFFICE

CERTIFICATE OF CORRECTION

PATENT NO. : 5,147,527

DATED : September 15, 1992

INVENTOR(S) : William P. Hettinger, Jr.

It is certified that error appears in the above-identified patent and that said Letters Patent is hereby corrected as shown below:

In Column 19, line 45, TABLE VI, after "X x 10", insert --$^{-6}$--.

Signed and Sealed this

Fifth Day of April, 1994

*Attest:*

*Attesting Officer*

BRUCE LEHMAN

*Commissioner of Patents and Trademarks*